United States Patent [19]

Kubli

[11] Patent Number: 4,928,618

[45] Date of Patent: May 29, 1990

[54] CONNECTOR FOR ATTACHING A FLOAT TO A SMALL BOAT ANCHOR LINE

[76] Inventor: Walter R. Kubli, 5040 S.W. Texas St., Portland, Oreg. 97219

[21] Appl. No.: 318,545

[22] Filed: Mar. 3, 1989

[51] Int. Cl.[5] ..... B63B 21/22

[52] U.S. Cl. ..... 114/293

[58] Field of Search ..... 114/50, 52, 221 R, 293, 114/294, 297, 299, 270, 210; 43/17.2

[56] References Cited

U.S. PATENT DOCUMENTS

| | | | |
|---|---|---|---|
| 1,771,406 | 7/1930 | Fountain | 114/293 |
| 3,062,168 | 11/1962 | Backe | 114/206 |
| 3,351,158 | 11/1967 | Kite | 188/65.4 |
| 3,654,649 | 4/1972 | Richardson | 114/206 |
| 3,818,524 | 6/1974 | Starkey | 114/206 |
| 3,838,657 | 10/1974 | Fleming | 114/230 |
| 3,922,990 | 12/1975 | Menard, Jr. | 114/221 |
| 4,067,287 | 1/1978 | Sabella | 114/299 |
| 4,161,922 | 7/1979 | Fogg | 114/299 |
| 4,552,087 | 11/1985 | Van Oene | 114/297 |

FOREIGN PATENT DOCUMENTS

| | | | |
|---|---|---|---|
| 0081258 | 6/1983 | European Pat. Off. | 114/210 |
| 0112301 | 6/1984 | European Pat. Off. | 114/299 |

*Primary Examiner*—Sherman D. Basinger
*Assistant Examiner*—Edwin L. Swinehart
*Attorney, Agent, or Firm*—Eugene M. Eckelman

[57] ABSTRACT

A tubular member includes a pair of cooperating sections hingedly connected together longitudinally thereof and arranged to be open to allow an anchor line to be inserted or removed laterally therein from the side. The cooperating sections have releasable fastening portions to allow insertion or removal of the anchor line. The tubular member has an anchor line engaging lever with an operative position capable of providing unidirectional axial movement of the anchor line through the tubular member. A float is connected directly to the anchor line engaging lever and controls the operation thereof in an anchor retrieving function, or in a function wherein the device serves as a marker buoy.

2 Claims, 1 Drawing Sheet

CONNECTOR FOR ATTACHING A FLOAT TO A SMALL BOAT ANCHOR LINE

BACKGROUND OF THE INVENTION

This invention relates to a new and useful connector for attaching a float to a small boat anchor line.

Devices have heretofore been used to assist in raising anchors associated with small boat anchor lines. As an example, U.S. Pat. No. 3,922,990 shows a float device which has unidirectional slidable movement on an anchor line and which in its unidirectional connection is arranged to lift an anchor on the line to the surface. By means of such structure, no appreciable manual labor is required to retrieve the anchor since the work is done by the boat and the buoyancy of the float. U.S. Pat. No. 4,552,087 also shows a device for lifting an anchor utilizing a float and also using movements of the boat to retrieve the anchor.

SUMMARY OF THE INVENTION

According to the present invention and forming a primary objective thereof, a connector has structure providing more convenient use and operation of a float type retrieval assembly for small boat anchors than prior devices.

Briefly stated, the connector of the invention comprises a tubular member including a pair of cooperating sections hingedly connected together longitudinally and arranged to be opened to allow an anchor line to be inserted or removed laterally, thus facilitating convenient attachment of the connector to and removal from an anchor line. The connector includes anchor line engaging means which operates to provide unidirectional axial movement of the anchor line through the tubular member. The anchor line engaging means is operatively connected to a float, and the buoyant effect of the float operates the unidirectional anchor line engaging means in an arrangement wherein pulling movement on the anchor line in a reverse direction, namely, a direction opposite from the current in which the boat is anchored will allow the float to bring the anchor to the surface when the latter is loosened from the bottom.

The invention will be better understood and additional objects and advantages will become apparent from the following description taken in connection with the accompanying drawings.

DETAILED DESCRIPTION OF A PREFERRED EMBODIMENT

Figure 2:
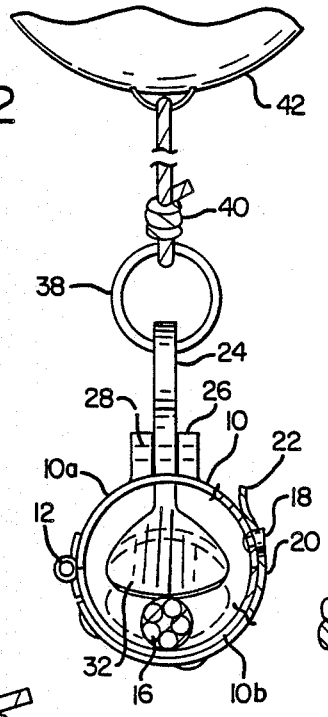
FIG. 2 is an end elevational view of the connector taken from the left side of FIG. 1, the connector also being closed on the anchor line.
Figure 1:
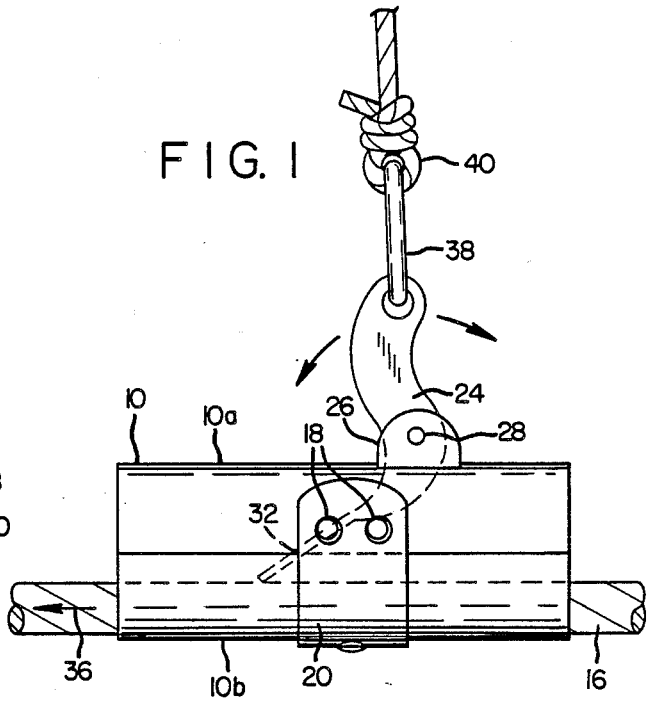
FIG. 1 is a side elevational view of the present connector in closed condition mounted on an anchor line.
Figure 3:
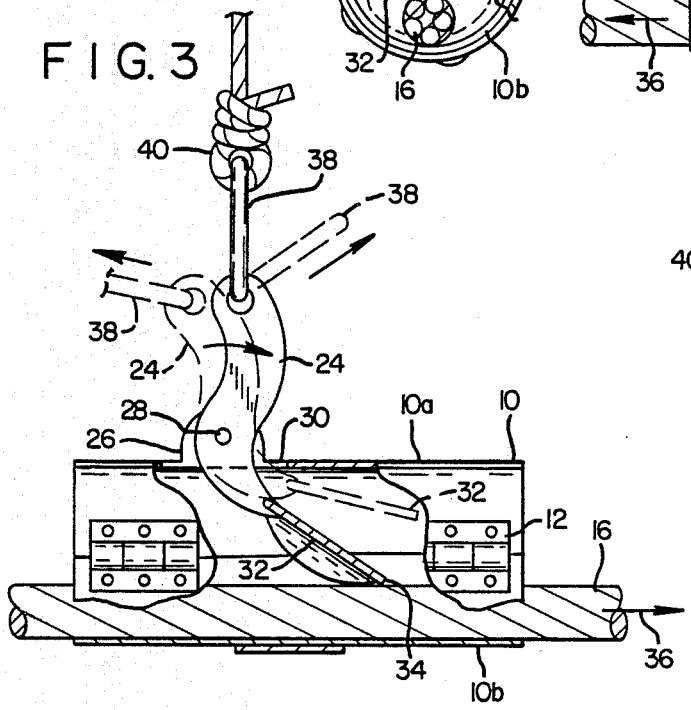
FIG. 3 is a side elevational view of the connector taken from the opposite side of FIG. 1.
Figure 4:
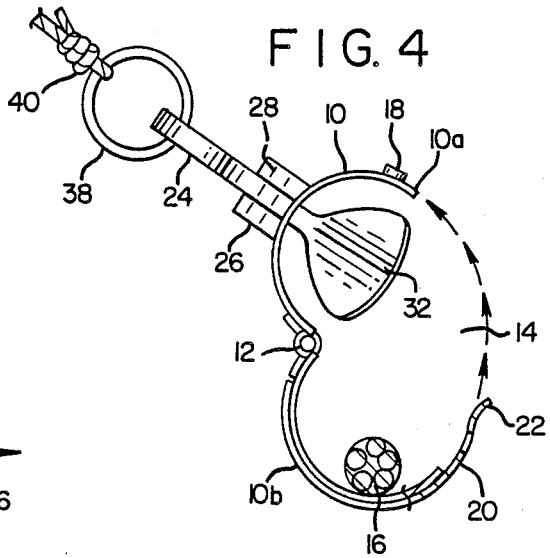
FIG. 4 is an end elevational view taken similar to FIG. 2 but showing the connector in open position.

With particular reference to the drawings, and first to FIGS. 1–4, the present connector comprises a tubular member 10 formed of two cooperating sections **10*a*** and

**10*b* hingedly connected along one longitudinal edge thereof by hinge means 12. As apparent in the drawings, the hinged sections are arranged to be closed for forming such connector, FIGS. 1–3, or opened, FIG. 4, to provide a side opening 14. As will be more apparent hereinafter, an anchor line 16 is readily inserted or removed from the connector when the latter is open. Section 10*a* is provided with detents 18 arranged for releasable engagement with an apertured spring latch plate 20 on section 10*b* to provide the releasable connection of the two tubular member sections. Spring latch plate 20 has an outwardly curved end finger extension 22 by means of which the plate 20 can be manually sprung outwardly for disengagement with the detents. This outwardly curved extension will ride over the detents in a closing movement of the two sections wherein detents 18 snap into the apertures in the plate 20** in the fully closed condition of the connector.

Connector 10 has a lever 24 thereon, this lever being supported intermediate the ends of the connector between a pair of ears 26 integral with the section **10*a* and supporting a pivot pin 28 for the lever therebetween. The section 10*a* has an opening 30 between the mounts 26 to receive an inner end of the lever. Such inner end comprises an S-shaped, blade-like portion 32 of a length and angle such that the end 34 thereof is arranged to bite or grip the anchor line in one direction thereof, namely, in an anchor line direction of movement relative to the tubular member opposite from the direction shown by arrows 36 in FIGS. 1 and 3. In view of the angled disposition of the blade 32, the anchor line can slide freely relative to the tubular member in the opposite direction of arrows 36**.

Figure 5:
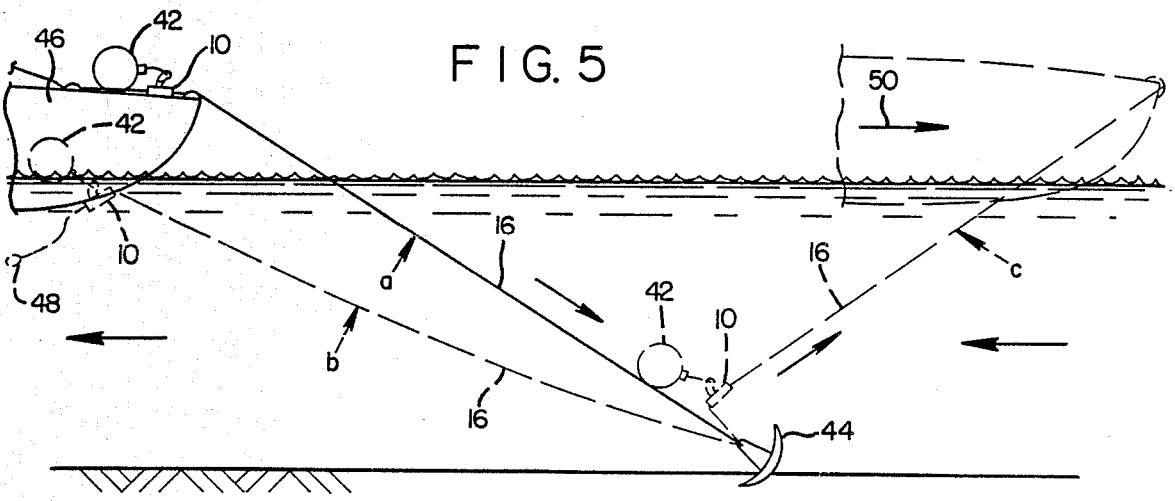
FIG. 5 is a diagrammatic view showing operative conditions of the connector whereby when associated with a float, the connector can cause the float to serve as a marker buoy or float an anchor to the surface.

The outer end of lever 24 has a ring connector 38 attached to a line 40 leading from a float 42, FIGS. 2 and 5.

With regard to the operation of the present connector, reference is made to FIG. 5 wherein the anchor line 16 is shown connected to a conventional anchor 44 or other device, such as a crab trap, etc. to be lifted from the bottom of a body of water. The numeral 46 designates a small boat. In a fishing or otherwise anchored position, the anchor line 16 is tied to the boat, generally to the bow, and the anchor 44 lowered to the bottom. In this anchored fishing position, designated by the reference position a of the anchor line, the float 42 and connector 10 tied thereto, such as by a line 40 a few inches long, is stored on the boat in inoperative position. As a marker buoy fuunction of the present connector and float, the connector can be attached to the anchor line adjacent the boat by opening the sections **10*a* and 10*b*, moving the connector laterally over the line, and then snapping the sections closed. The boat can then be untied from the anchor line and the float 20 dropped in the water, whereby the boat can be maneuvered independently of the anchor to land a fish or other purpose, the float 42 being retained by the anchor and serving as a marking buoy for the return of the boat to an anchored position. This marker buoy position is designated by the reference position b of the anchor line. The connector will grip the anchor line as soon as it and the float are dropped into the water since the current will exert a pull on the lever 24 to urge it to the full line positions shown in FIGS. 1 and 3. The tension created by the buoyancy and current maintains a grip on the anchor line such that the connector cannot move in a direction away from the anchor. To insure that the connector 10** will not accidentally slip off the end of the anchor line in unusual circumstances, the anchor line is provided with an end enlargement 48, such as a knot.

As a primary purpose of the connector 10 and float 42, the anchor can be conveniently retrieved by the action of the float and the boat. The float has sufficient buoyancy to lift the anchor and associated portions, such as submerged portions, of the anchor line. Assuming that the boat is in its anchored position, as designated by reference position a of the anchor line, the connector 10 is snapped onto the anchor line adjacent the boat. The weight thereof will cause it to slide down to the water level, it being apparent that the connector has free sliding movement at all times toward the anchor. With the anchor line attached to the boat, the boat is then driven in the opposite direction of the current, namely, in the direction of arrow 50. This forced reverse movement of the upper portion of the anchor line and the secured or stationary position of the anchor 44 pulls the lever to the phantom line position shown in FIG. 3 and causes the float to be driven down the anchor line to the anchor. This condition of the float and the anchor line is designated by the reference position c of the anchor line. Thereupon, as soon as the anchor is released and the boat stopped, some of the releasing force for the anchor being accomplished by the buoyancy of the float 42, the latter will start upwardly. As the float moves upwardly, it pulls on the lever 24 which causes the blade 32 to bite into the anchor line and provide a lift connection between the float and the anchor. The anchor will thus rise with the float. It is merely necessary then for the boater to retrieve the float when it gets to the surface and lift the anchor from the surface of the water.

In accordance with the present invention, an anchor retrieving device is provided that needs only minimum manual effort to retrieve an anchor. Importantly, the snap-on connector 10 eliminates the necessity of pulling the anchor line through any connector means when it is desired to initiate another anchor lifting function or to store the anchor when it is placed in the boat since it can be readily taken off or snapped on the line. As noted herein, the releasable connector is also instrumental for using the float as a marker buoy.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A connector for attaching a float to an anchor line, comprising:

a tubular member having open ends, said tubular member including a pair of cooperating sections hingedly connected together longitudinally thereof and arranged to be opened to allow the anchor line to be inserted or removed laterally from the side, releasable fastening means on said tubular member arranged to connect said sections together to confine the anchor line therein or to allow insertion or removal of the anchor line, and a lever pivotally mounted on said tubular member having a projecting end connected directly to a float and an inner blade end engageable with the anchor line for providing unidirectional movement of the anchor line under the influence of the float.

2. In combination, a tubular member having open ends, said tubular member including a pair of cooperating sections hingedly connected together longitudinally thereof and arranged to be opened to allow an anchor line to be inserted laterally therein from the side, releasable fastening means on said tubular member arranged to connect said sections together to confine the anchor line therein or to allow insertion or removal of the anchor line, a float and a radially extending lever pivotally mounted on said tubular member having a projecting end connected directly to said float and an inner blade end engageable with the anchor line for providing unidirectional movement of the anchor line under the influence of said float.

* * * * *